US005967877A

United States Patent [19]

Howard

[11] Patent Number: 5,967,877

[45] Date of Patent: Oct. 19, 1999

[54] BRA WITH REINFORCED CONTOURLINE

[76] Inventor: Jack E. Howard, 2343 Century Hill, Los Angeles, Calif. 90067

[21] Appl. No.: 09/111,354

[22] Filed: Jul. 7, 1998

[51] Int. Cl.[6] ..... A41C 3/10

[52] U.S. Cl. ..... 450/57; 450/53; 2/267

[58] Field of Search ..... 450/51–57; 2/24, 2/463, 267

[56] References Cited

U.S. PATENT DOCUMENTS

| | | | |
|---|---|---|---|
| 2,495,307 | 1/1950 | Abramson | 2/463 |
| 2,824,563 | 2/1958 | Hill . | |
| 2,896,631 | 7/1959 | Block | 2/267 |
| 3,799,175 | 3/1974 | Rowell . | |
| 4,235,240 | 11/1980 | Cousins . | |
| 4,295,469 | 10/1981 | Lindgren . | |
| 4,646,746 | 3/1987 | O'Boyle . | |
| 4,798,557 | 1/1989 | Scott . | |
| 4,816,005 | 3/1989 | Braaten . | |
| 5,033,986 | 7/1991 | Feigenbaum . | |
| 5,387,150 | 2/1995 | Terrell . | |
| 5,472,366 | 12/1995 | Moore . | |
| 5,685,764 | 11/1997 | Kostritzky . | |
| 5,700,288 | 12/1997 | Eaton . | |
| 5,769,688 | 6/1998 | Holliday | 450/57 |

FOREIGN PATENT DOCUMENTS

| | | |
|---|---|---|
| 384951 | 9/1990 | European Pat. Off. . |
| 2046583 | 10/1995 | U.S.S.R. . |

*Primary Examiner*—Gloria Hale

*Attorney, Agent, or Firm*—McCutchen, Doyle, Brown & Enersen LLP

[57] ABSTRACT

A flexible support structure shaped to conform to the cup portion of breast-supporting garments is described. The support structure may be constructed from a polyurethane foam or similar material and comprises a rib molded onto the lower U-shaped edge to provide support and yet sufficient flexibility. The present support structure thus eliminates the need for underwire structures and allows ease of manufacture, eliminates damage caused to the fabric by conventional underwire structures, and also provides enhanced comfort to a user.

7 Claims, 3 Drawing Sheets

BRA WITH REINFORCED CONTOURLINE

1. FIELD OF THE INVENTION

This invention relates to a wireless support element for the cups of breast supporting garments.

2. DESCRIPTION OF RELATED ART

Devices intended to provide support and shaping for the cups of a bra and similar articles have long been known. These devices are commonly known as underwires and are inserted into and held within a fabric sleeve disposed about the periphery of the lower section of the bra cup. They are made from materials, such as metal or bone, and are provided in various forms and shapes. Most commonly, the underwire is formed of relatively thin metallic pieces of rectangular cross-section, shaped into an essentially semicircular or U-shaped conformation which allows the wire to be fitted within a sleeve disposed about the periphery of the lower half of the bra cup. While such underwire structures have achieved widespread usage, a number of significant disadvantages result from their use.

In particular, underwire structures formed of metal can damage the fabric sleeve into which the underwire is inserted or to irritate the skin of a user leading to substantial discomfort and in some instances bruising. Storing, washing and drying of bras containing underwires also leads to deformation or distortion of the wires. Multiple washings lead to degradation of the fabric of the garment due to shrinkage of the fabric and/or the relative movement occurring between the stiff, rigid metal underwire and the fabric of the bra brought about by the mechanical actions encountered in machine washing and drying. These problems can be avoided only to some degree by using underwires coated with a polymeric material or metal underwires that have plastic tips at their ends, but even these measures are insufficient to overcome the problems mentioned above.

In addition, support structures such as underwires require a different wire design for each bra model differing in style, size and/or manufacturer and each has to be sewn into a fabric sleeve of the bra during assembly. This requires additional labor and costs to manufacture in addition to the costs of the added material.

Thus, there is currently no underwire structure available which is lightweight, provides shape and support and at the same time is comfortable to a user even after numerous washings and dryings, and causes no damage to the fabric.

3. SUMMARY OF THE INVENTION

It is a primary object of the present invention to provide a wireless support structure for breast-supporting articles, such as bras (with or without straps), swimwear, sportswear, contour or bra pads and the like, that provides the necessary rigidity to accomplish its supporting function.

It is another object of the invention to provide a support structure that eliminates the possibility of damaging the fabric of a garment or the skin of a wearer caused by any undesirable movements as is the case of a conventional underwire sewn into a fabric sleeve.

Another object of the invention is to provide a support for use in association with a cup of a bra or related garment which retains its shape and function over time, even after repeated machine washings and dryings.

Still yet a further object of the present invention is to provide a support structure for a bra, which is easier and quicker to assemble and thus can be accomplished at substantially reduced production and labor costs.

These and other objects of the invention are accomplished by the present invention which provides a wireless support structure which is lightweight, soft and comfortable to a user while reducing the potential for damage to the fabric of the bra or irritation of the body of the wearer, in which the metal underwire is eliminated, thus eliminating damage due to the wire protruding through the fabric and excessive wearing during machine washing and drying.

The support structure is molded in a single piece from a polymeric material, shaped to conform to the cup portion of a bra or similar article, with a rib along the lower edge to provide support and yet sufficient flexibility so that the bra is comfortable to the wearer. The rib is located at a specified distance from the lower periphery and has different cross-sections along its length, thus providing the lift. The rib is a thin strip of polyester, polyurethane or other foamlike material which is part of the bottom of a molded pad. The strip extends out from the cup to form a control platform upon which the bust rests on. The garment now gives the wearer a natural comfort not previously achieved and provides an alternative for women who cannot wear a bra with a metal underwire.

The material of the support structure is a plastic or other flexible material which performs the intended functions, and the material and thickness can be varied according to the rigidity and stability desired.

4. BRIEF DESCRIPTION OF DRAWINGS

5. DETAILED DESCRIPTION OF THE INVENTION

Figure 1:
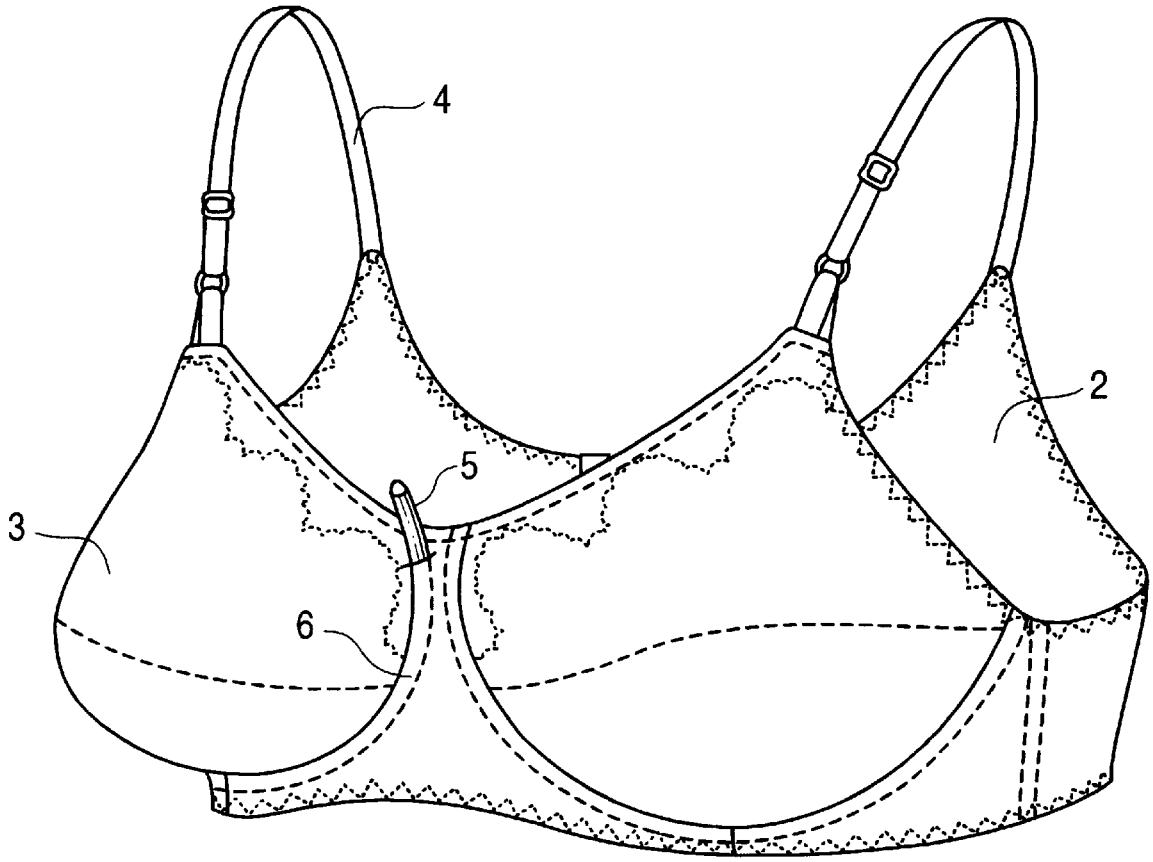
FIG. 1 is a perspective view of a conventional bra having an underwire as a support structure.

Referring now in greater detail to the drawings, FIG. 1 illustrates a perspective view of a bra 1 which includes a frame 2, a pair of breast receiving cups 3, a pair of shoulder straps 4, and a conventional underwire 5 fitted in a sleeve 6. The most common underwires available today include (i) a metal underwire with a substantially rectangular cross-sectional shape with or without a plastic coating, (ii) a metal underwire containing a rounded, plastic tip at the exposed end to reduce potential damages to the fabric, and (iii) an underwire structure formed entirely of a rigid plastic material with a substantially "barbell" cross-sectional shape.

Common problems associated with such conventional underwires encased in fabric sleeves include (i) protrusion due to the rigidity of the structure which causes damages to the fabric and pain or discomfort to the wearer, (ii) the need for special sewing techniques to hold the underwire in place, (iii) the lack of resiliency leading to distortion of the garment and prohibiting machine washing and drying of the garment.

Figure 2:
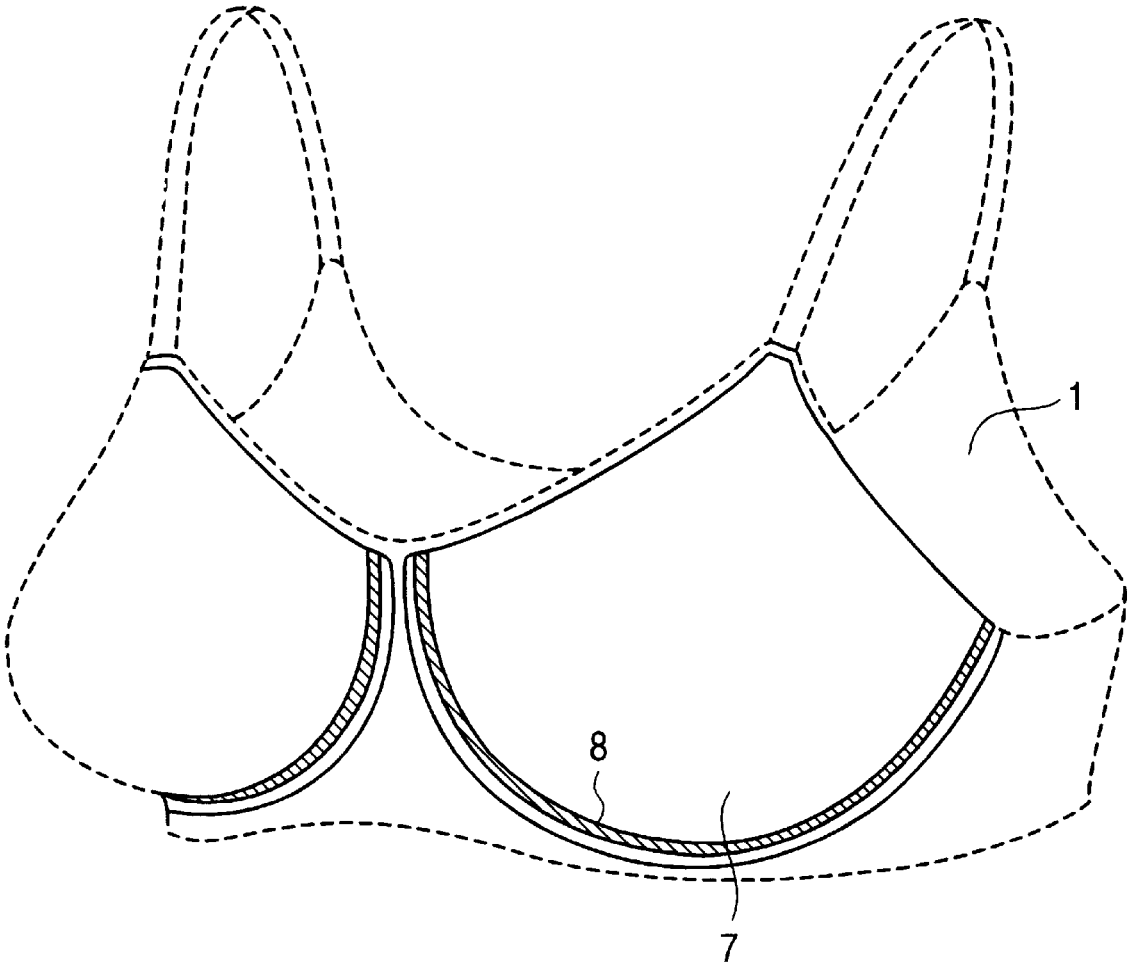
FIG. 2 is a perspective view of the support element according to the invention used in association with a bra.

FIG. 2 illustrates the present invention wherein the main body of bra 1 (dotted lines) comprises a cup-shaped, wireless support structure 7 (solid lines) with a rib 8 along the lower edge of the periphery. As contrasted with conventional underwires sewn into fabric sleeves, the support structure of the present invention is molded in a single piece which allows the structure to hold its original shape throughout the life of the garment in which it is used. This also allows the use of different resins, and both thickness and shape can be easily controlled to produce tailormade products to suit all figures. The structure may be of a variety of polymeric materials, is preferably light in weight, strong yet flexible, soft, resilient, and resistant to water, solvents, and chemicals found in liquid detergents, as well as non-allergic. Preferably, the structure is made from polymeric materials such as polyethylene foam, polyurethane foam, or a vinyl foam. If the structure is intended to be used in swimwear, a closed cell or other waterproof foam will be used. All these materials are washable, will take perma-press, and will resist disintegration in temperatures up to 360° F.

Figure 3:
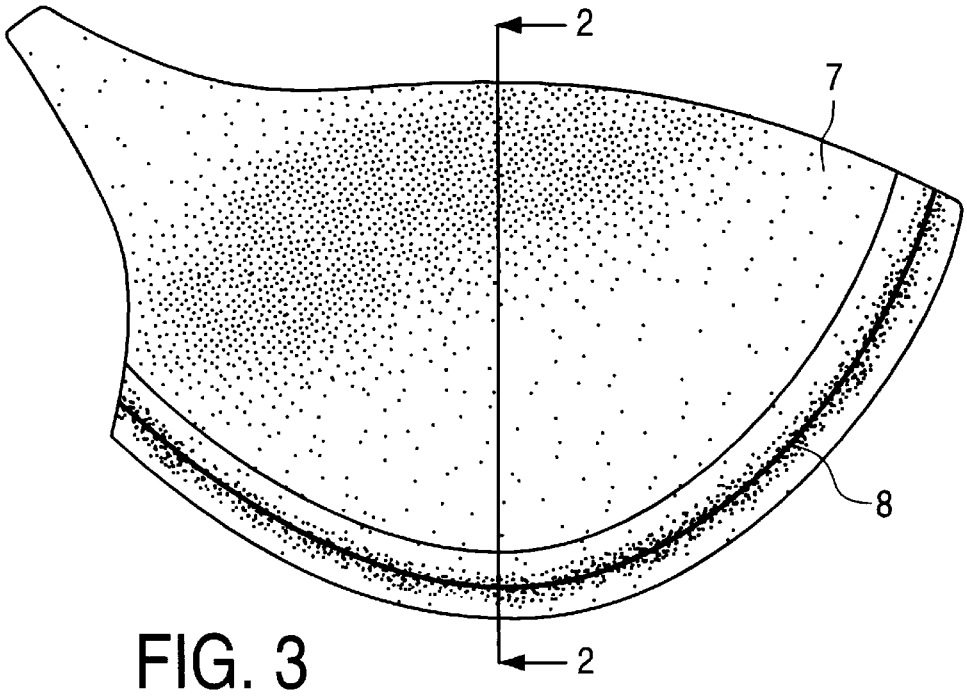
FIG. 3 is a perspective view of the support element according to the invention.
Figure 4:
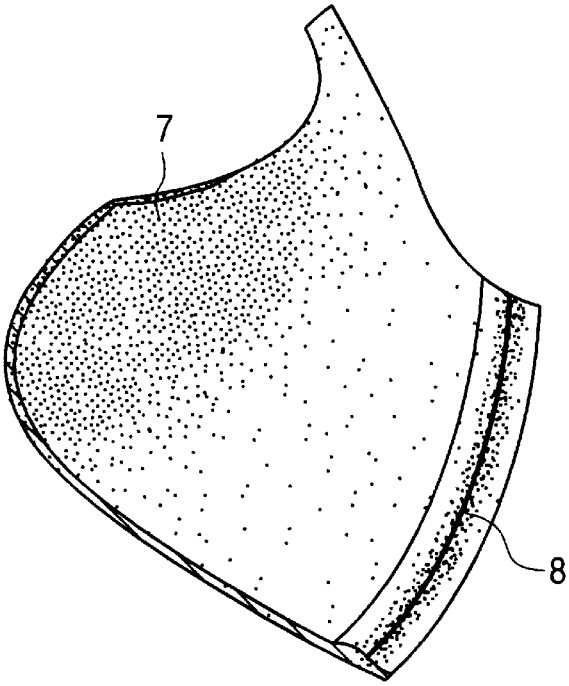
FIG. 4 is a cross-section taken along 2—2 of FIG. 3.

The present invention cannot cause damage to the fabric, or cause discomfort or pain to the wearer as is the case with wire reinforcements. Thus, the support structure of the invention is able to perform all of the required support functions, while also possessing long-lasting properties and enhanced comfort for the user. Furthermore, labor and manufacturing costs are reduced since the support is a single article which can easily be sewn directly into the garment FIGS. 3 and 4 illustrate the support structure of the invention in detail (without the bra). FIG. 3 is a perspective view, while FIG. 4 illustrates a cross-section through the support structure.

The support structure may be formed using conventional injection molding or similar techniques and can be molded to essentially any density and thickness, as will be recognized by those skilled in the art. The support structure can similarly be molded in any diameter which provides the necessary support functions and comfort, but the typical thickness for the support structure will range from approximately ⅜" to about 3". In a preferred embodiment, the support is approximately 1" thick in the center and tapers to a thickness of approximately ⅜" towards the opposing ends of the support. In another preferred embodiment, the support is approximately 1½" thick in the center and tapers to a thickness of approximately ⅜" towards the opposing ends of the support. In yet another preferred embodiment, the support is approximately 1¾" thick in the center and tapers to a thickness of approximately ⅜" towards the opposing ends of the support. In a fourth embodiment, the support is approximately 2" thick in the center and tapers to a thickness of approximately ⅜" towards the opposing ends of the support.

Figure 5:
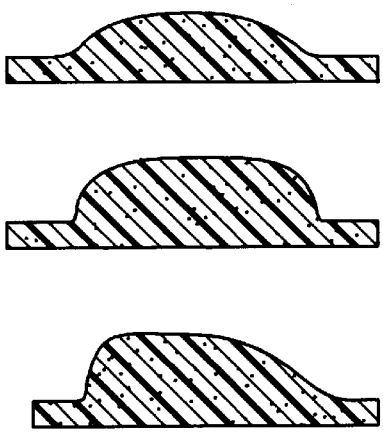
FIG. 5 illustrates three different cross-sections of the rib.

The rib extends along the lower U-shaped edge of the support structure and can accommodate various cross-sections. In a preferred embodiment, the rib is approximately ⅛" to about ⅜" wide and approximately ⅜" from the edge of the support. Preferred cross-sectional configurations are shown in FIG. 5 and include semi-circular (including semi-oval and semi-elliptical) and tear-shaped configurations.

The rigidity and flexibility of these support structures, combined with the lack of protrusion of stiffening material generates a supportive bra structure, which is comfortable to the wearer and yet provides the desirable and necessary support.

In conclusion, the support device of the present invention provides substantial advantages over conventional underwire structures, especially with respect to user comfort and reduction of damage to the fabric as in a conventional bra. The structure of this invention also has the advantages of being less expensive to manufacture because there is no wire to be purchased or inserted into a sleeve and the time and labor are also considerably reduced as there is no sewing required. The advantages provided by the present support structure result from a particular combination of structural features in a single structural element, thus providing an unexpected and beneficial result over conventional underwire bras, providing enhanced support and comfort to a user.

While the invention has been described herein primarily as a support element for a cup used in a bra, it is to be understood that the invention can be utilized as a support element in other breast-supporting articles, for example swimwear or other sportswear garments. It is also apparent that the optimum dimensional relationships of the invention include variations in size, materials, shape, form, function and manner of operation, assembly and use, and are deemed obvious to one skilled in the art, and all equivalent relationships to those illustrated in the drawings and described in the specification are intended to be encompassed by the present invention.

Thus, the foregoing is considered as illustrative only of the principles of the invention and does not limit the invention to the exact construction and operation shown and described, but includes the various modifications and changes that occur to those skilled in the art.

What is claimed is:

1. A support structure for a breast supporting article, comprising a soft and flexible cup-shaped pad of a polymeric material having an essentially U-shaped lower edge portion, and a support rib extending along said U-shaped lower edge portion on the inner side of said cup-shaped pad.

2. The support structure of claim 1, wherein said polymeric material is a polyurethane, polyethylene, or vinyl foam.

3. The support structure of claim 1, wherein said rib is of a semi-circular cross-section.

4. The support element of claim 1, wherein said rib is about ⅜" wide.

5. The support element of claim 1, wherein said rib is approximately ⅜" from the edge of said lower bottom edge.

6. The support element of claim 1, wherein said rib has a thickness ranging from about ⅜" to 2".

7. The support element of claim 1, wherein said rib is about 1" to about 3" thick and tapers towards the opposing ends to a thickness of ⅜".

* * * * *